US010932509B2

(12) United States Patent
Doubt et al.

(10) Patent No.: US 10,932,509 B2
(45) Date of Patent: Mar. 2, 2021

(54) SYSTEM AND METHOD OF SUPPLEMENTING HUMAN HAIR VOLUME

(71) Applicants: Ruxton C. Doubt, Kent, WA (US); Roark Michael Doubt, Vashon, WA (US)

(72) Inventors: Ruxton C. Doubt, Kent, WA (US); Roark Michael Doubt, Vashon, WA (US)

(73) Assignee: Fucina, Inc., Kent, WA (US)

( * ) Notice: Subject to any disclaimer, the term of this patent is extended or adjusted under 35 U.S.C. 154(b) by 161 days.

(21) Appl. No.: 16/093,519

(22) PCT Filed: Apr. 4, 2017

(86) PCT No.: PCT/US2017/025976
§ 371 (c)(1),
(2) Date: Oct. 12, 2018

(87) PCT Pub. No.: WO2017/180370
PCT Pub. Date: Oct. 19, 2017

(65) Prior Publication Data

US 2019/0125021 A1 May 2, 2019

Related U.S. Application Data

(60) Provisional application No. 62/321,990, filed on Apr. 13, 2016.

(51) Int. Cl.
*A41G 5/00* (2006.01)

(52) U.S. Cl.
CPC ..... *A41G 5/0066* (2013.01); *A41G 5/0086* (2013.01)

(58) Field of Classification Search
CPC .. A41G 5/0066; A41G 3/0008; A41G 3/0016; A41G 5/004; A41G 5/0046; A41G 5/0053; A41G 5/006; A41G 5/0073; A41G 5/008; A41G 5/0086
USPC ..... 132/53, 54, 55, 56, 201
See application file for complete search history.

(56) References Cited

U.S. PATENT DOCUMENTS

| | | | |
|---|---|---|---|
| 3,295,534 A | 1/1967 | Dorkin | |
| 4,934,387 A | 6/1990 | Megna | |
| 5,107,867 A | 4/1992 | Barrington | |
| 5,752,530 A | 5/1998 | Traintinger | |
| 5,784,747 A | 7/1998 | Girardot et al. | |
| 5,787,747 A * | 8/1998 | Bevk | B21C 1/003 72/16.5 |

(Continued)

FOREIGN PATENT DOCUMENTS

DE 102005033189 A1 1/2007

*Primary Examiner* — Nicholas D Lucchesi
(74) *Attorney, Agent, or Firm* — Seed IP Law Group LLP

(57) ABSTRACT

A system having a sleeve, a rod, a microtube, a transitional member, and an acceptance member. The rod is sized and shaped to have an outer diameter that is smaller than a width of an existing hair and configured to accept the sleeve. The transitional member is sized and shaped to enable the sleeve to be slid from the rod and stretched onto the microtube. The microtube is sized and shaped to accept the existing hair and the sleeve. The acceptance member is sized and shaped to enable the existing hair to be positioned into the microtube. When the sleeve is slid off the microtube and onto the existing hair, the sleeve constricts towards its original diameter, thus gripping the existing hair.

20 Claims, 10 Drawing Sheets

(56) References Cited

U.S. PATENT DOCUMENTS

| | | | | |
|---|---|---|---|---|
| 5,894,846 | A | 4/1999 | Gang | |
| 5,937,867 | A | 8/1999 | Williams | |
| 6,820,625 | B2 | 11/2004 | Park | |
| 6,837,249 | B2 | 1/2005 | Smith | |
| 6,938,624 | B2 | 9/2005 | Arroyo et al. | |
| 7,192,635 | B2 | 3/2007 | Ott | |
| 7,614,403 | B2 | 11/2009 | Nomura | |
| 7,726,321 | B2 | 6/2010 | Arroyo et al. | |
| 8,944,076 | B1 | 2/2015 | Doubt | |
| 9,877,530 | B2 * | 1/2018 | Doubt | A41G 5/0046 |
| 2004/0103910 | A1 | 6/2004 | Ott | |
| 2004/0149302 | A1 | 8/2004 | Toda | |
| 2004/0173223 | A1 | 9/2004 | Hu | |
| 2004/0173233 | A1 | 9/2004 | Tokko | |
| 2005/0268932 | A1 | 12/2005 | Gold | |
| 2011/0056507 | A1 | 3/2011 | Tokko | |
| 2012/0124777 | A1 | 5/2012 | Keller | |
| 2016/0000165 | A1 | 1/2016 | Doubt | |

* cited by examiner

SYSTEM AND METHOD OF SUPPLEMENTING HUMAN HAIR VOLUME

CROSS REFERENCE TO RELATED APPLICATION

This application claims the benefit under 35 U.S.C. § 119(e) to U.S. Provisional Application 62/321,990 filed Apr. 13, 2016, which application is incorporated by reference herein in its entirety.

BACKGROUND

Technical Field

The present disclosure is directed to supplementing existing human hair and, more particularly, to adding volume by attachment of additional hair strands to a host strand of hair.

Description of the Related Art

It is known that hair transplants only achieve a 30% to 50% increase in hair density. While an increase of 50% in hair density generally looks better, a lower density of hair improvement usually presents a thin head of hair. Ideally, the goal is to obtain a thickening of 100% or more of existing hair.

Prior methods are problematic because of limitations on reusability. For example, adhesives have been used to glue or bond additional hair to an existing hair shaft. The difficulty with adhesives is that they are exposed to the elements, such as rain, the ocean, sweat, as well as chemicals from shampoo, which can break down the adhesive. When the adhesive breaks down, the bond fails, resulting in hair loss.

Other methods and devices include the use of metal clamps. Such clamps require special tools to attach the clamp to the hair. In order to adjust and accommodate growing hair, the clamps must be unclamped and reclamped, resulting in tedious and expensive labor. Metal fatigue is also an issue with these types of clamps. Moreover, the use of thousands of clamps in a head of hair may cause allergic reactions, and these clamps can be easily snagged or pulled with a comb or brush.

Another approach has been to use thermal plastic tubes that are shrunk onto the hair with the application of heat. Such heat-shrunk tubes are difficult to adjust because they require reheating, which can be damaging to existing hair and the scalp, and such tubes are usually not able to be reheated and reapplied.

In general, existing methods and devices are one-time applications only. The practicality of attempting to adjust these existing hair supplementation devices while attached to the existing hair makes them unusable, for all intents and purposes.

BRIEF SUMMARY

In accordance with one aspect of the present disclosure, a system and method for supplementing existing hair is provided, which can include thickening of the hair by adding hair extensions to a host hair to increase volume, such as density or length or both. The system includes a sleeve, a rod, a microtube, a transitional member, and an acceptance member. The rod is sized and shaped to have an external surface that has an outer diameter that is smaller than a width of the existing hair and configured to accept the sleeve on the external surface. The rod is configured to enable the sleeve to slide along the external surface of the rod. The sleeve is formed on the rod, such as by dipping the rod into a liquid latex rubber solution multiple times to create multiple coatings. Supplemental hairs are added to the sleeve in between coatings while the latex is still wet. The transitional member is sized and shaped to enable the sleeve to be slid from the external surface of the rod and stretched onto an external surface of the microtube. The microtube is sized and shaped to have an internal bore that is configured to accept the existing hair and an external surface that has an outer diameter that is larger than the outer diameter of the external surface of the rod. The acceptance member is sized and shaped to enable the existing hair to be positioned into the internal bore of the microtube. The microtube is configured to enable the sleeve to slide off the external surface of the microtube and onto the existing hair. When the sleeve is slid off the microtube and onto the existing hair, the sleeve constricts towards its original diameter, thus gripping the existing hair.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that the present disclosed implementations may be practiced without one or more of these specific details, or with other methods, components, materials, etc. In other instances, well-known structures or components, or both, that are associated with the environment of the present disclosure have not been shown or described in order to avoid unnecessarily obscuring descriptions of the implementations.

Unless the context requires otherwise, throughout the specification and claims that follow, the word "comprise" and variations thereof, such as "comprises" and "comprising," are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

The present disclosure is directed to a system and method of using an elastic sleeve (or tube) to attach several supplemental hairs (synthetic or real) to a host hair, such as a human hair growing out of the scalp. In so doing the hair density (i.e., the number of hairs per square inch) will be increased, giving the prospective user the potential for a fuller head of hair. Several procedures and components are utilized to create the sleeve, position the sleeve onto a component that can allow an installer to put the sleeve onto a host hair, and position the host hair into such a component.

Figure 1:
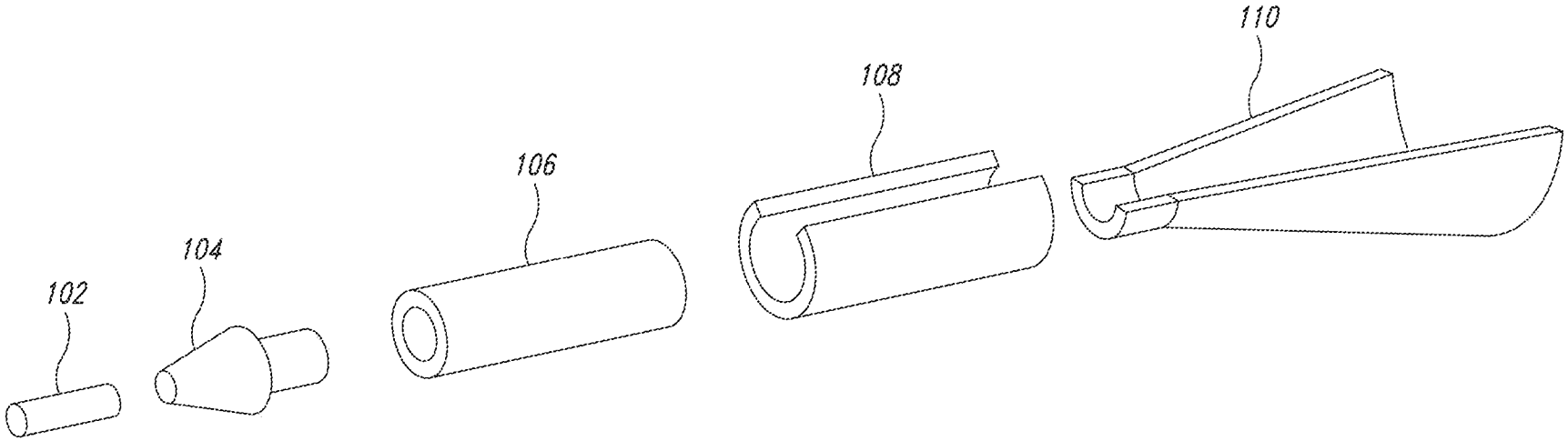
FIG. 1 is an exploded view of a supplemental hair installation system that includes a rod, a transitional member, a microtube, a connector member, and an acceptance member in accordance with the present disclosure.

FIG. 1 is an exploded view of a supplemental hair installation system in accordance with the present disclosure. The system includes a rod 102, a transitional member 104, a microtube 106, a connector member 108, and an acceptance member 110. Briefly, a sleeve 210 (shown in FIGS. 2A-2E) is formed onto the rod 102. The rod 102 is attached to the transitional member 104, which is inserted into the microtube 106. The sleeve is slid from the rod 102 up and over the transitional member 104 and onto the microtube 106. Once the sleeve is positioned on the microtube 106, the transitional member 104 and the rod 102 can be removed from the microtube 106. The acceptance member 110 is connected to the microtube using the connector member 108. The connector member 108 slides over a portion of the acceptance member and a portion of the microtube 106, but does not interfere with the sleeve on the microtube. The acceptance member 110 enables a host hair (not illustrated) to be inserted into the microtube 106. Once the host hair is inserted into the microtube 106, the connector member 108 and the acceptance member 110 can be removed from the host hair, leaving the microtube 106 on the host hair. The sleeve is then slid off the microtube 106 and onto the host hair, resulting in a host hair with a sleeve having one or more supplemental hairs. Each of the components illustrated in FIG. 1 and their function is described in more detail in the following description of the figures.

For ease of discussion, the outside diameters of the rod 102, the microtube 106, and a host hair (e.g., host hair 408) will be described in generic units to show the relationship between the different diameters of the various components. It should be recognized that each person's hair can have a different diameter (e.g., between 0.04 mm to 0.15 mm), so the units described herein can be adjusted for a specific diameter of hair, such as that of a user. In some implementations, example measurements may also be given. In various implementations, a target or average host hair diameter can also be used. In this way, small, medium, and large sleeves can be created for the different thicknesses of human hair.

FIGS. 2A-2E are side views of the process of creating a sleeve 210 with supplemental hairs 214 on a rod 102. In various implementations, a host hair may be assumed to have a width or diameter of two units. In this case, the rod 102 has an outside diameter of one unit, so that once formed onto the rod 102, a sleeve 210 has a natural diameter of one unit, which is smaller than the diameter of the host hair. In at least one implementation the diameter of the rod may be approximately 0.05 mm (e.g., if the rod is a 44 gauge wire), which results in a sleeve 210 with a natural internal diameter of approximately 0.05 mm.

Figure 2D:
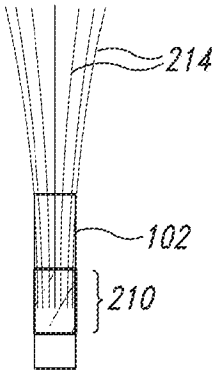
FIGS. 2A-2G are side views of the process of creating a sleeve with supplemental hairs onto the rod in accordance with the present disclosure.
Figure 2C:
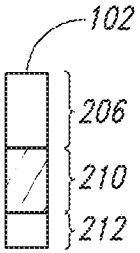
Figure 2B:
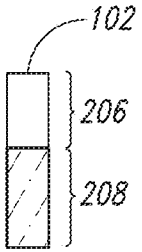
Figure 2A:
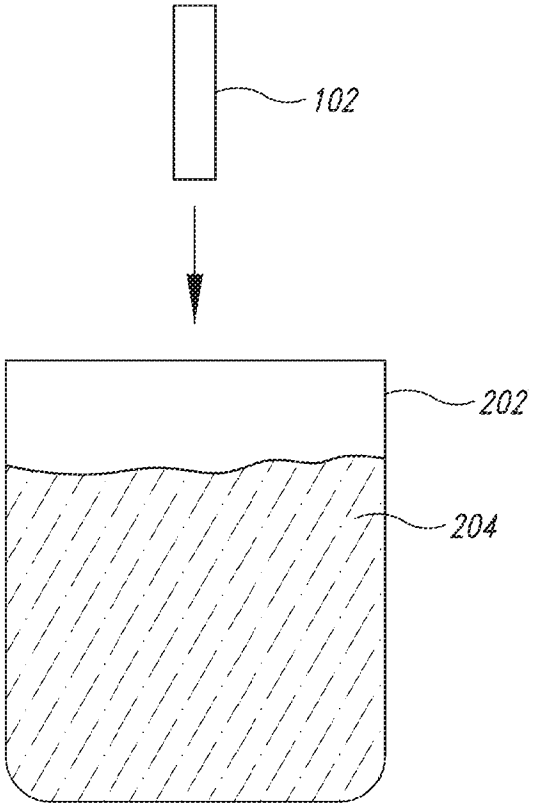

The rod 102 is dipped into a container 202 of liquid latex rubber 204, e.g., as illustrated in FIG. 2A. The liquid latex rubber 204 sticks to the rod 102 so that when the rod 102 is removed from the latex rubber 204, a layer of wet latex 208 is formed on the rod 102. In some implementations, one or more portions 206 and 212 of the rod 102 may be treated or configured so that the liquid latex rubber 204 does not adhere to the rod 102, e.g., as illustrated in FIGS. 2B-2C. For example, portions 206 and 212 of the rod 102 may be nano coated, covered in a release agent, or polished such that the sleeve 210 (once the liquid latex rubber cures) can easily slide on the rod 102. In this way, the sleeve 210 is created on the rod 102.

After the rod 102 is dipped into the liquid latex rubber 204, the supplemental hairs 214 are added to the sleeve 210, as illustrated in FIG. 2D. In various implementations, the supplemental hairs 214 may be aligned and laid on a flat surface. After the rod 102 is dipped into the liquid latex rubber 204 and before the liquid latex rubber has a chance to cure, the rod 102 is rolled through the supplemental hairs 214 so that the supplemental hairs 214 are substantially parallel to the rod 102 with one end of the supplemental hairs 214 being in the sleeve 210. It should be understood that other methods of positioning the supplemental hairs 214 into the liquid latex rubber of the sleeve 210 may be utilized. In some implementations, the supplemental hairs 214 may be coated with a bonding agent to help them bind to the latex rubber in the sleeve 210.

After the supplemental hairs 214 have been added to the sleeve 210 and the sleeve 210 has cured, the rod 102 may be re-dipped into the container 202 of the liquid latex rubber 204 to add additional latex to the sleeve 210. In various implementations, this re-dipping procedure is performed such that the supplemental hairs 214 are not dipped into the liquid latex rubber 204, as illustrated in FIG. 2E. In this way, a coating of the liquid latex rubber 204 can form around the supplemental hairs 214 on the sleeve 210 without getting all over the supplemental hairs 214. These additional coatings can help stabilize and attach the supplemental hairs 214 to the sleeve 210.

In various implementations, the rod 102 may be dipped into the liquid latex rubber 204 one or more times (e.g., between four and ten times, or even more) before or after, or before and after, the supplemental hairs 214 are added to the sleeve 210. In some implementations, the supplemental hairs 214 may be added over the course of multiple coatings. For example, the rod may be dipped in the liquid latex and two hairs may be added to this first coat of the liquid latex. After the first coat cures, the rod may be dipped again to create a second coat. After the second coat cures, the rod may be dipped again and two more hairs may be added to this third coat. After the third coat cures, the rod may be dipped again, resulting in a sleeve with four coats of latex. It should be recognized that multiple coats can be used to create the sleeve and that one or more hairs can be added to one or more coats of the sleeve.

Figure 2F:
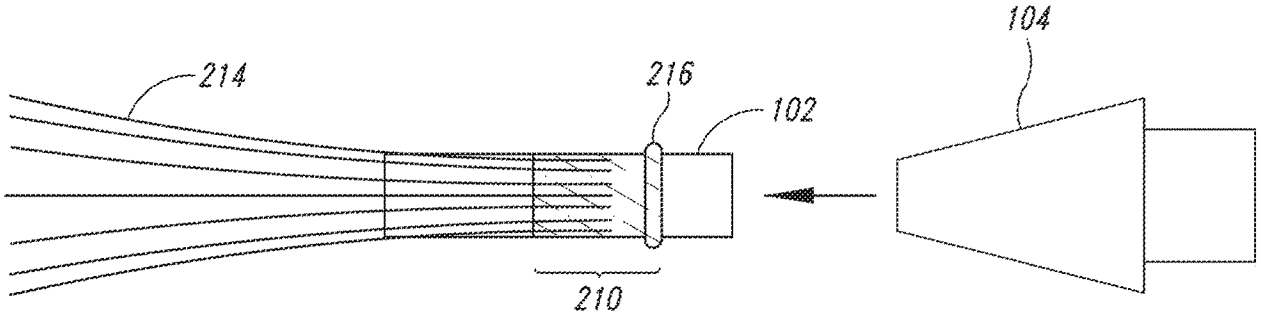

In various implementations, a ridge 216 may be formed on the sleeve 210, as shown in FIG. 2F. The ridge 216 provides a surface for a manufacturer to grab onto the sleeve 210 when moving the sleeve 210 from the rod 102 and onto the microtube 106, as described herein. In some implementations, the ridge 216 is removed once the sleeve is moved onto the microtube 106. But in other implementations, the ridge 216 is left on the sleeve 210 so that an installer has a surface to grab onto when adjusting a position of the sleeve on the host hair once the sleeve is installed on the host hair (e.g., move the sleeve closer to the scalp as the host hair grows out). The ridge 216 may be formed by performing multiple additional dips of the rod 102 into the liquid latex rubber 204, but only on a portion of the sleeve 210. Although the ridge 216 is described as being formed by multiple partial dips or coatings of the liquid latex rubber 204 on the sleeve 210, the disclosure is not so limited, and other methods of building up a ridge or ring on a liquid latex rubber cylinder may be employed, such as by rolling up the end of the sleeve.

Figure 2G:
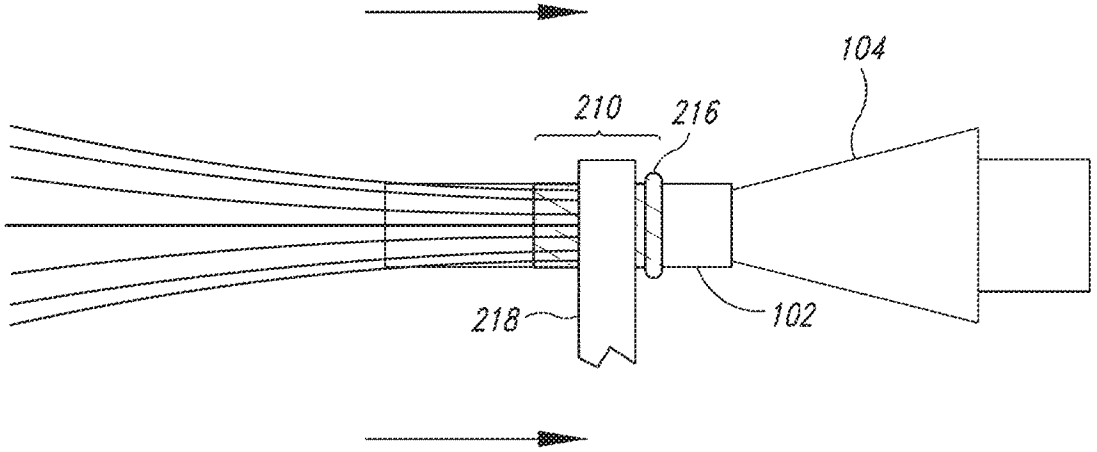
Figure 2E:
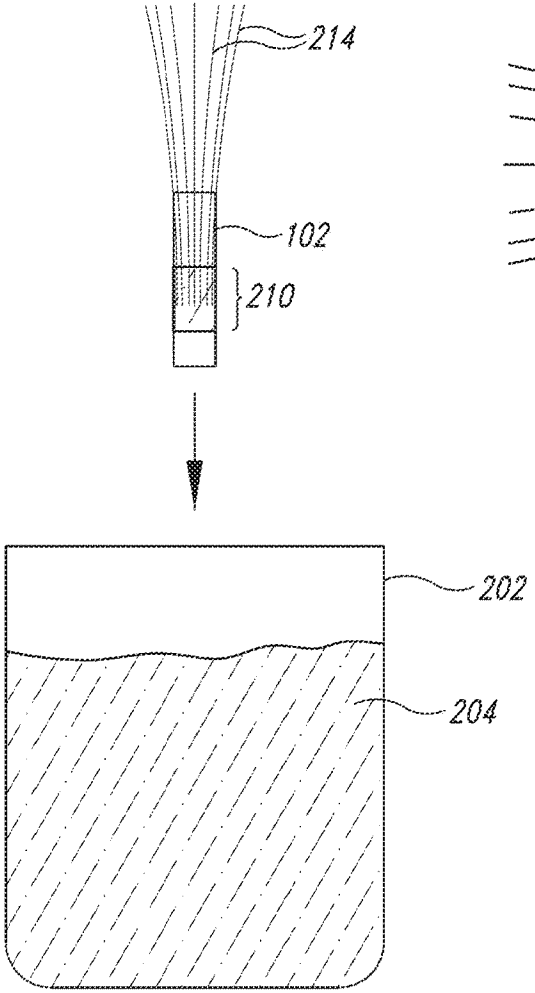
Figure 3A:
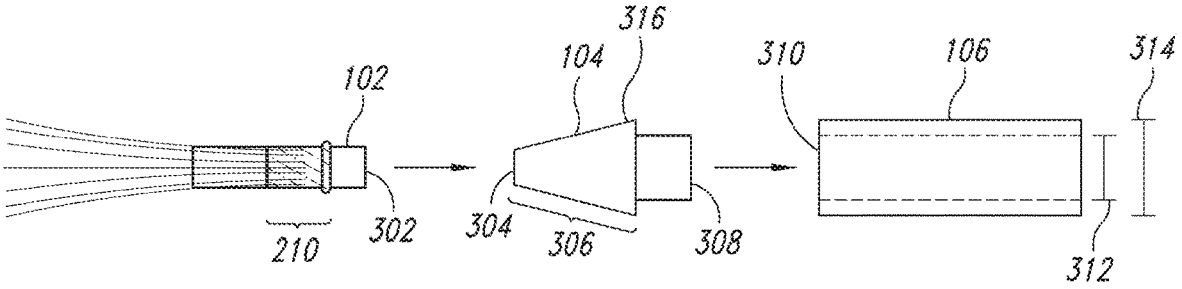
FIGS. 3A-3D are side views of the process of sliding the sleeve from the rod over the transitional member and onto the microtube in accordance with the present disclosure.
Figure 3B:
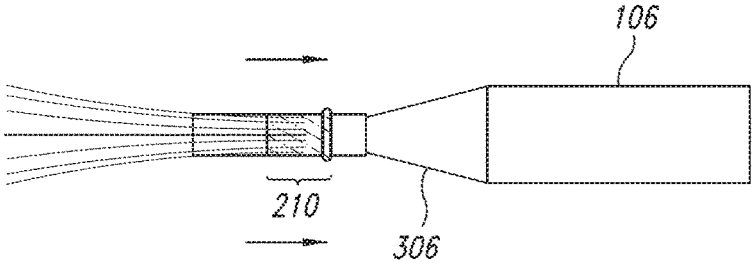
Figure 3C:
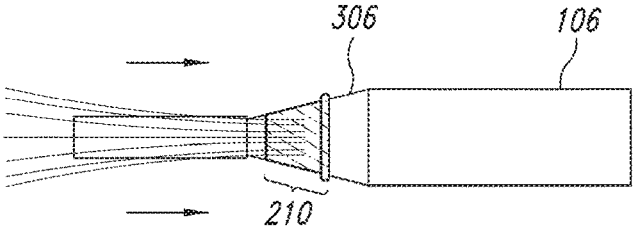
Figure 3D:
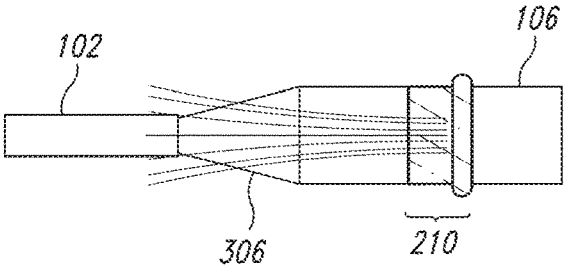
Figure 4A:
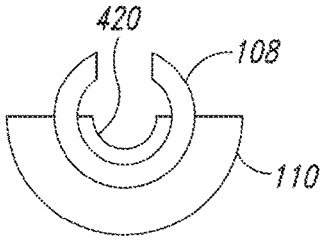
FIG. 4A is an end view of the connector member and the acceptance member in accordance with the present disclosure.
Figure 4B:
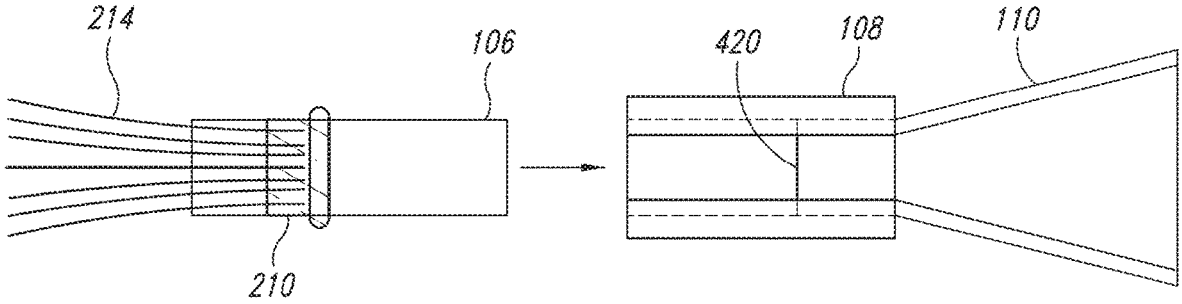
FIGS. 4B-4C are top views of the microtube, connector member, and acceptance member to accept a host hair in the microtube in accordance with the present disclosure.
Figure 4C:
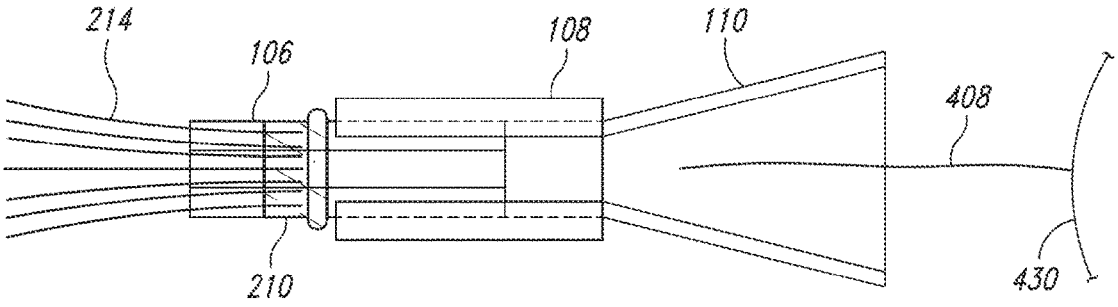
Figure 4D:
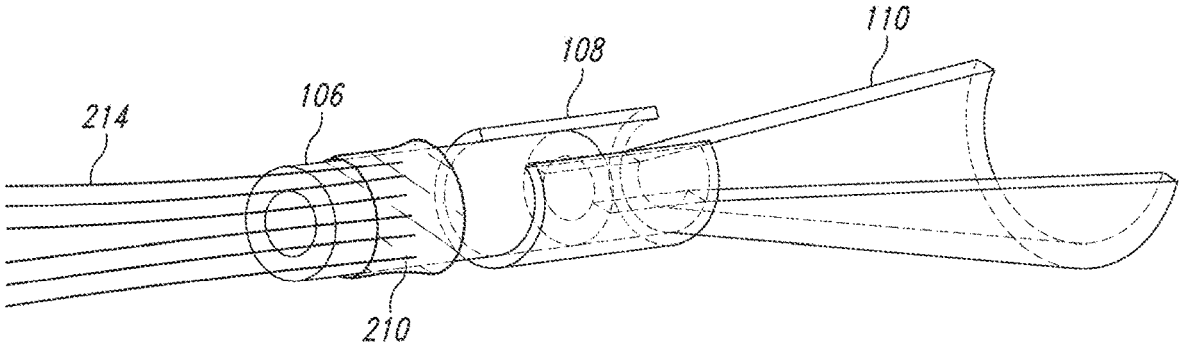
FIG. 4D is a perspective view of the microtube, connector member, and acceptance member to accept a host hair in the microtube in accordance with the present disclosure.
Figure 4E:
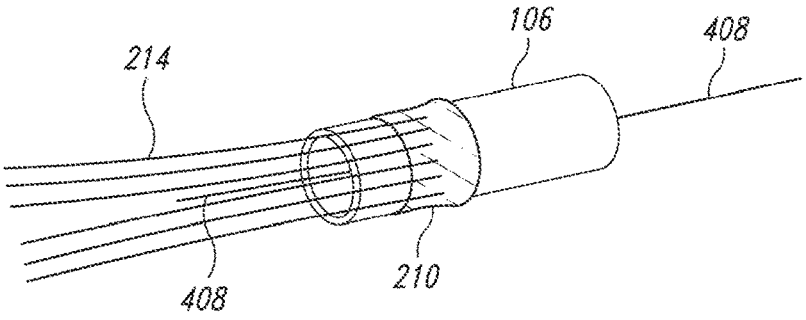
FIG. 4E is a perspective view of the microtube with a host hair in accordance with the present disclosure.

After the sleeve 210 is formed on the rod 102, the rod 102 is attached to the transitional member, as illustrated in FIGS. 2F and 2G. Pliers 218 are used to slide the sleeve 210 off the rod 102 and onto the transitional member 104, which is illustrated in FIG. 2G. The pliers 218 may be sized and shaped to be slightly curved to fit around the sleeve 210 and engage the ridge 216. The ridge 216 provides a surface for the pliers 218 to push against to slide the sleeve 210 along the length of the rod 102. In some implementations, the pliers 218 may be fused into the ridge 216 by applying extra coats of liquid latex rubber.

In some implementations, the rod 102 may include micro grooves formed at an angle into the rod. The micro grooves may be formed such that when the rod 102 is dipped into the liquid latex rubber 204, the liquid latex rubber 204 picks up or maps these indentations, thus forming micro grooves on the inside diameter of the sleeve. In various implementations, the micro grooves may be angled in a same direction as the supplemental hairs 214 so that the sleeve 210 can only slide in one direction, which is opposite of the supplemental hairs 214. In this way, the sleeve 210 can still be slid from the rod 102 to the microtube 106 and onto a host hair, as described herein. And since the micro grooves are angled towards the supplemental hairs, the sleeve would resist moving in that direction once the sleeve is positioned on a host hair, while still allowing the sleeve to move towards the scalp for repositioning.

FIGS. 3A-3D are side views of the process of sliding the sleeve 210 from the rod 102 over the transitional member 104 and onto the microtube 106. In various implementations, the microtube 106 has an outside diameter of four units and an inside diameter of three units. In at least one implementation, the microtube 106 has an outside diameter of 0.2 mm and an inside diameter of 0.15 mm.

The transitional member 104 includes a tip 304, a midsection 306 and a base 316. In various implementations, the tip 304 has a diameter of one unit and the base 316 has a diameter of four units, and the midsection 306 has a diameter that is tapered from one unit at the tip 304 to four units at the base 316.

A first end 302 of the rod 102 is attached to the tip 304 of the transitional member 104 using an adhesive or other attachment compound. The tip 304 of the transitional member 104 is the same diameter as or slightly smaller than the outside diameter of the first end 302 of the rod 102, which helps to allow the sleeve 210 to slide from the rod 102 and onto the transitional member 104. In various implementations, the transitional member 104 is nano coated, covered in a release agent, or polished such that the sleeve 210 can easily slide on the transitional member 104.

The transitional member 104 also includes a shaft 308 to engage the microtube 106 and temporarily connect the transitional member 104 to the microtube 106. The shaft 308 of the transitional member 104 has an external diameter that is sized and shaped to fit inside a first end 310 of the microtube 106, which has an internal diameter 312. The first end 310 of the microtube 106 abuts a base 316 of the transitional member 104. A diameter of the base 316 is the same as or slightly larger than a diameter 314 of the microtube 106, which helps to allow the sleeve 210 to slide from the transitional member 104 to the microtube 106.

Once the rod 102 is connected to the transitional member 104, and the transitional member 104 is engaged with the microtube 106, the sleeve 210 can be slid from the rod 102 onto the transitional member 104 and onto the microtube 106. In various implementations the microtube 106 has an outside diameter of four units (although some larger or smaller diameters may be employed, depending on the elastic properties of the sleeve 210). The midsection 306 of the transitional member 104 is sized and shaped to change the diameter of the sleeve 210 as the sleeve is slid from the rod 102 to the microtube 106. In various implementations, the midsection 306 is frustoconical or otherwise tapered from the tip 304 to the base 316. In various implementations, the microtube 106 is nano coated, covered in a release agent, or polished such that the sleeve 210 can easily slide on the microtube 106.

After the sleeve 210 is completely on the microtube 106, the rod 102 and transitional member 104 are removed from the microtube 106. The connector member 108 and acceptance member 110 are then connected to the microtube 106 to allow a host hair to be positioned inside the microtube 106.

FIGS. 4A-4E show various views of the interaction between the microtube 106, the connector member 108, and the acceptance member 110, and the insertion of a host hair 408 into the microtube 106.

The connector member 108 enables the acceptance member 110 to couple to and abut the end of the microtube 106 so that the acceptance member 110 is temporarily connected to the microtube 106. The connector member 108 and the acceptance member 110 may be permanently connected, or they may be separate but engage with one another when inserting a free end of the host hair 408 into the microtube 106, as illustrated. The connector member 108 and the microtube 106 are sized so that the microtube 106 slides inside the connector member 108. The connector member 108 can be referred to as a two-thirds cylinder since it does not fully close around the microtube 106 and includes a gap along the length of the connector member 108. It should be recognized that the connector member 108 may be more or less than two-thirds, but sized and shaped so that the connector member 108 engages the microtube 106 when the microtube is partially inserted into the connector member 108, and so that the connector member 108 can be separated from the microtube 106 (by sliding the connector member 108 off the microtube 106) and removed from the host hair 408 once the host hair 408 is inserted into the microtube 106.

The acceptance member 110 is a half-funnel-like shape. The open half of the acceptance member 110 is positioned in a same direction as the gap in the connector member 108, which allows the acceptance member 110 to be removed from the host hair 408 once the host hair 408 is inserted into the microtube 106. When inserted into the connector member 108, the microtube 106 abuts a first end 420 of the acceptance member 110. The first end 420 includes a wall thickness that is the same as (or slightly larger than) the thickness of the wall of the microtube 106, such that the internal surface of the microtube 106 aligns with an internal surface of the acceptance member 110, which allows the host hair 408 to slide from the acceptance member 110 into the microtube 106 without interruption. In various implementations, the first end 420 has the same dimensions as the microtube 106, but is only a half section, again to allow the acceptance member 110 to be removed once the host hair 408 is inserted into the microtube 106.

In various implementations, the sleeve 210 may be created on the rod 102 and moved onto the microtube 106 by a manufacturer prior to installation. The manufacturer may also attach the connector member 108 and the acceptance member 110 to the microtube 106. This combination of components maybe provided to the installer as the resulting product (i.e., the sleeve with the supplemental hairs) and the installation tool (i.e., the microtube, connector member, and acceptance member). Therefore, a plurality of product/installation tools can be used by an installer (e.g., a hair stylist) to provide enhanced hair density for a user.

In other implementations, the connector member 108 and the acceptance member 110 may not be utilized to guide the host hair 408 into the microtube 106. Rather a thread and lasso method may also be used. In at least one such implementation, the thread would pass through the microtube 106 from the end with the supplemental hairs 214 towards the user's scalp 430. On the end with the user's scalp 430 is a lasso configured into the tread. In this way, an installer can capture the host hair 408 with the lasso and then pull the thread back through the microtube 106, which results in the host hair 408 being pulled through the microtube 106. The sleeve 210 is then slid off the microtube 106 and onto the host hair 408, as discussed in more detail below.

In some other implementations, the sleeve 210 could be slid off the microtube 106 and onto the thread prior to a host hair being captured by the lasso. In this way, the installer would receive the sleeve 210 on a thread and lasso (without the microtube 106) and the installer can capture the host hair 408 with the lasso and then pull the host hair 408 through the sleeve 210 by pulling the thread and lasso back through the sleeve 210. In some implementations, the host hair or the thread, or both, may be lubricated to help enable the thread and host hair to be pulled through the sleeve. Similarly, the sleeve 210 may include a ridge 216, as discussed elsewhere herein, to help enable the installer to slide the sleeve onto the host hair.

Figure 5A:
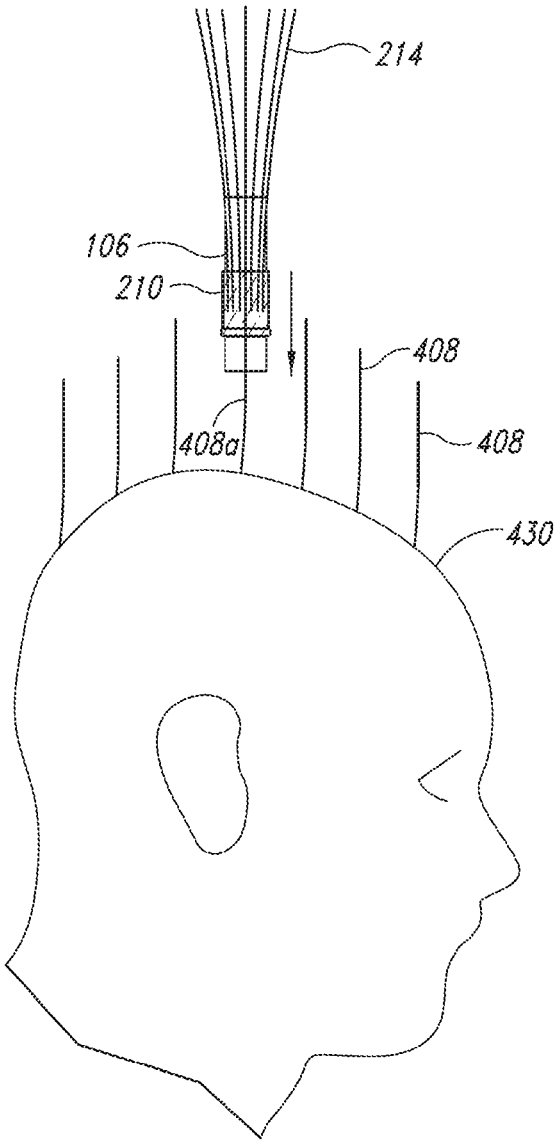
FIGS. 5A-5C are side views of the process for sliding the sleeve off the microtube and onto the host hair in accordance with the present disclosure.
Figure 5B:
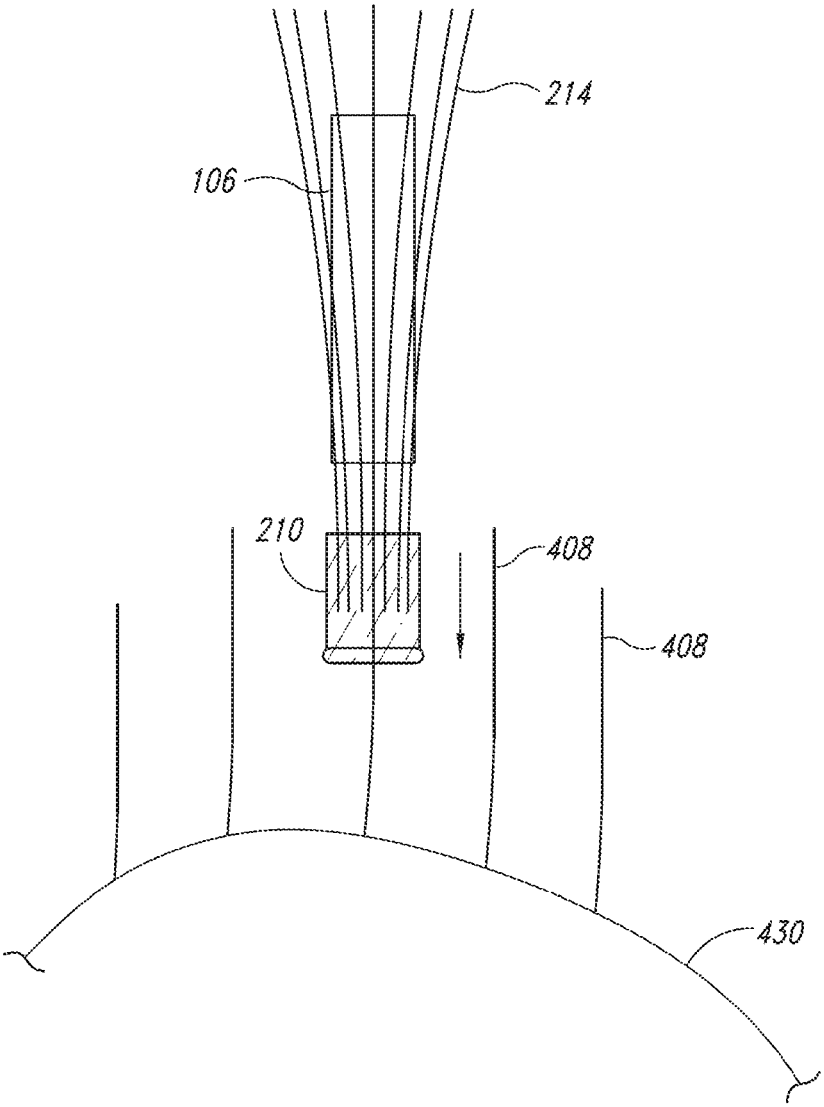
Figure 5C:
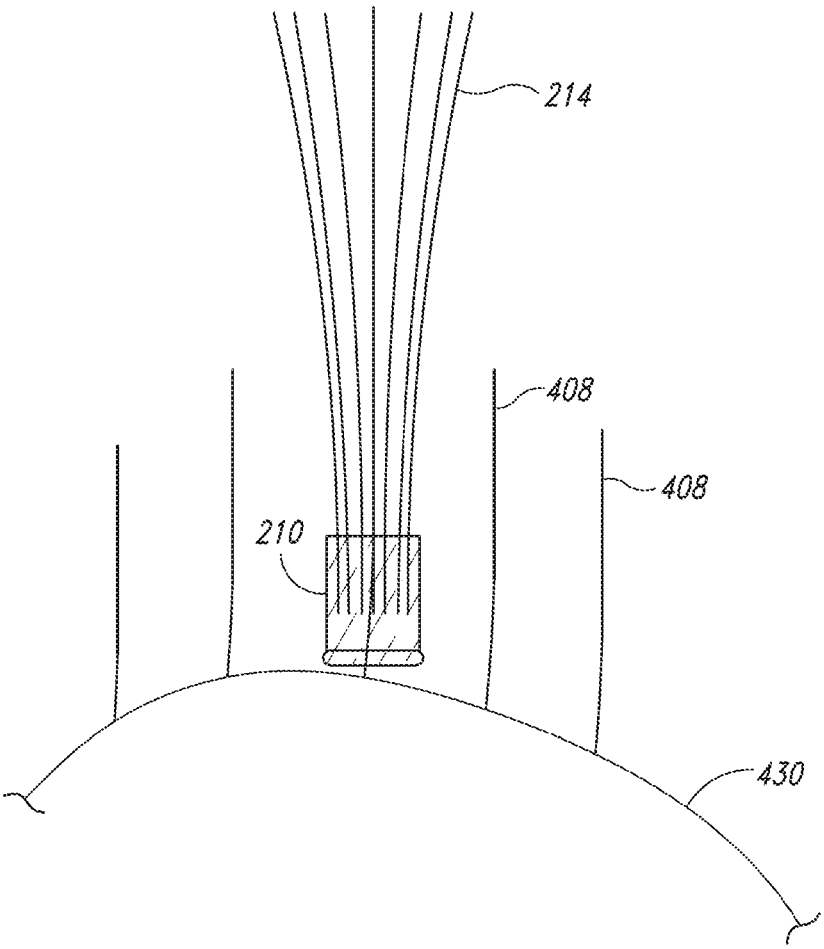

FIGS. 5A-5C are side views of the process for sliding a sleeve 210 off a microtube 106 and onto a host hair 408. After a host hair 408*a* is inserted into the microtube 106, such as described above in conjunction with FIGS. 4A-4E, the sleeve 210 is slid down off the microtube 106 and towards the scalp 430. In some implementations, pliers (not illustrated), similar to what is described above, may be used to slide the sleeve 210 off the microtube 106. Since the sleeve 210 has a natural diameter that is smaller than the diameter of the host hair 408*a* (e.g., roughly the diameter of the rod 102 that the sleeve 210 was formed on), and since the diameter of the sleeve 210 was stretched when the sleeve 210 was moved from the rod 102 over the transitional member 104 and onto the microtube 106, the diameter of the sleeve 210 will shrink back to substantially its natural diameter when the sleeve 210 is slid off the microtube 106. And since the natural diameter is smaller than the diameter of the host hair 408*a*, the sleeve 210 will grip the host hair. Once the sleeve 210 is on the host hair 408 it may be positioned closer to the scalp 430 so that the sleeve 210 is hidden against the scalp 430 and under the supplemental hairs 214. It should be noted that a sleeve 210 may not be placed on every hair on a user's head, although they could be. Rather, a separate sleeve 210 may be placed on every fifth hair (or other density), such that if a hair with a sleeve falls out another sleeve 210 can be placed onto an adjacent host hair.

In some implementations, an adhesive may also be added to the sleeve 210 to further ensure that the sleeve 210 will stay on the host hair 408. The adhesive may be added to the host hair 408 prior to sliding the sleeve 210 off the microtube 106 and onto the host hair 408. Alternatively, or additionally, the adhesive may be added to the outside of the microtube 106, such that the inside of the sleeve 210 becomes at least partially coated with the adhesive when the sleeve 210 is slid off the microtube 106 and onto the host hair 408. In yet other implementations, the sleeve 210 itself may be pre-conditioned with adhesive, such as a head sensitive adhesive that activates under higher temperatures.

Figure 6:
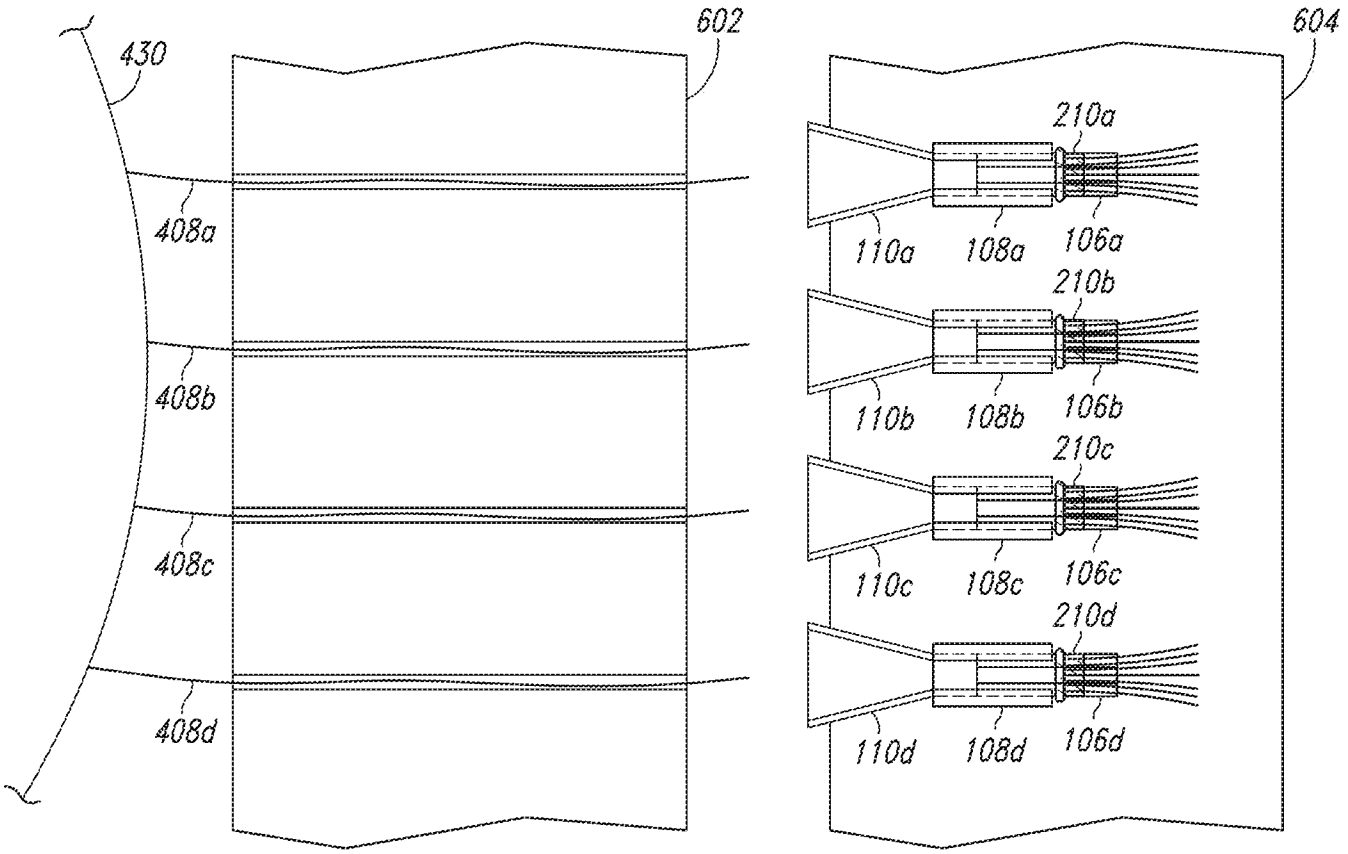
FIG. 6 is a top view of a plurality of plates that are used to insert multiple hairs into multiple sleeves at once in accordance with the present disclosure.

FIG. 6 is a top view of a plurality of plates that are used to insert multiple host hairs 408*a*-408*d* into multiple sleeves 210*a*-210*b* at once. A first plate 602 includes a plurality of grooves for each separate host hair 408*a*-408*d* to be arranged in a direction away from a user's scalp 430. A second plate 604 includes a plurality of product/installation tools that are created as described herein. When the plates 602 and 604 are aligned, the host hairs 408*a*-408*d* align with the corresponding acceptance members 110*a*-110*d*, which allows the host hairs 408*a*-408*d* to be slid into the corresponding microtubes 106*a*-106*d*. Once the host hairs 408*a*-408*d* are slid into the corresponding microtubes 106*a*-106*d*, the connector members 108*a*-108*d* and the acceptance members 110*a*-110*d* are removed so that the sleeves 210*a*-210*d* can be slid off the corresponding microtubes 106*a*-106*d* and onto the corresponding host hairs 408*a*-408*d*, as described above.

The various implementations described above can be combined to provide further implementations. In addition, while the present disclosure has been described in the context of human hair, it will be appreciated that it can be utilized on any hair or flexible filament that has the characteristics of hair. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A system to increase hair density of existing hair, the system comprising:

a rod having an external surface;

a sleeve with one or more supplemental hairs extending therefrom and an internal bore sized and shaped to be slidably received over the external surface of the rod;

a microtube having an internal bore to receive the existing hair and an external surface; and a transitional member having a tip opposite a shaft and an internal bore, the rod received in the internal bore of the transitional member proximate the tip.

2. The system of claim 1, further comprising:

an acceptance member sized and shaped to guide the existing hair into the internal bore of the microtube.

3. The system of claim 2, further comprising:

a connector member sized and shaped to align and connect the acceptance member with the microtube.

4. The system of claim 1, wherein at least one of the external surface of the rod, the transitional member, and the external surface of the microtube are treated to ease sliding of the sleeve along the rod and onto the transitional member and onto the microtube and onto the existing hair.

5. The system of claim 1, wherein the transitional member includes the tip, a midsection extending from the tip, and a base extending from the midsection, the tip sized and shaped to accept the sleeve from the rod, the midsection sized and shaped to expand the sleeve as it is slid from the tip to the base of the transitional member, and the base sized and shaped to enable the sleeve to be slid from the transitional member onto the external surface of the microtube.

6. The system of claim 1, wherein the shaft is sized and shaped to fit into the internal bore of the microtube to temporarily secure the transitional member to the microtube.

7. A system to increase hair density of existing hair, the system comprising:

a rod that has an external axial surface, the external axial surface of the rod having an outside diameter that is smaller than a width of the existing hair;

a sleeve that includes one or more supplemental hairs extending therefrom and configured to slide along the external axial surface of the rod;

a transitional member that includes a tip, a midsection, and a base along a central axis of the transitional member, the tip sized and shaped to accept the sleeve from the rod, the midsection sized and shaped to expand the sleeve as it is slid from the tip to the base of the transitional member, and the base being multiple times larger than the outside diameter of the external axial surface of the rod; and a microtube that has an internal axial bore and an external axial surface, the external axial surface of the microtube having an outside diameter that is sized to enable the sleeve to be slid from the base of the transitional member onto the external surface of the microtube, the internal axial bore of the microtube having an internal diameter that is larger than the width of the existing hair to allow the existing hair to slide through the internal axial bore of the microtube, the microtube configured to enable the sleeve to slide off the external axial surface of the microtube and onto the existing hair.

8. The system of claim 7, wherein the outside diameter of the external surface of the rod is one-half of the width of the existing hair.

9. The system of claim 7, wherein the outside diameter of the external axial surface of the microtube is four times the outside diameter of the external surface of the rod.

10. The system of claim 7, wherein the transitional member includes a shaft sized and shaped to fit into the internal axial bore of the microtube and temporarily secure the transitional member to the microtube as the sleeve is slid from the rod over the transitional member and onto the microtube.

11. The system of claim 7, further comprising:

an acceptance member sized and shaped to guide the existing hair into the internal axial bore of the microtube; and a connector member sized and shaped to align the microtube and the acceptance member, the connector member including an internal axial bore and a gap that is parallel to the internal axial bore of the connector member.

12. A method to increase hair density of existing hair, the method comprising:

forming a sleeve having one or more supplemental hairs extending from the sleeve on a rod having an external surface;

sliding the sleeve off the rod and onto a transitional member;

sliding the sleeve off the transitional member and onto an external surface of a microtube;

inserting the existing hair into an internal bore of the microtube; and sliding the sleeve off the microtube and onto the existing hair.

13. The method of claim 12, wherein the forming of the sleeve further comprises:

coating an external surface of the rod with liquid latex rubber;

positioning a first end portion of each of the one or more supplemental hairs in the liquid latex rubber such that a second end portion of each of the one or more supplemental hairs extends away from the liquid latex rubber with the one or more supplemental hairs being substantially parallel to the rod; and curing the liquid latex rubber to form the sleeve.

14. The method of claim 13, further comprising:

applying at least one additional coating of the liquid latex rubber to the sleeve over the first end portion of each of the one or more supplemental hairs to encase each of the one or more supplemental hairs into the sleeve.

15. The method of claim 13, further comprising:

applying at least one additional coating of the liquid latex rubber to a first end of the sleeve to form a ridge on the sleeve for aiding in sliding the sleeve.

16. The method of claim 12, further comprising:

treating the external surface of the rod, the transitional member, and the external surface of the microtube with a release agent to ease the sliding of the sleeve along the rod and onto the transitional member and onto the microtube and onto the existing hair.

17. The method of claim 12, further comprising:

before the sliding of the sleeve off the rod and onto the transitional member, attaching the rod to the microtube and temporarily attaching the transitional member to the microtube.

18. The method of claim 17, further comprising:

before the inserting of the existing hair into the internal bore of the microtube and after the sleeve is slid onto the external surface of the microtube, removing the transitional member from the microtube.

19. The method of claim 12, further comprising:

before the inserting of the existing hair into the internal bore of the microtube, connecting, to the microtube, an acceptance member sized and shaped to enable the existing hair to be positioned into the internal bore of the microtube.

20. The method of claim 19, further comprising:

before the sliding of the sleeve off the microtube and onto the existing hair, removing the acceptance member from the microtube.

* * * * *